US007350247B2

(12) United States Patent
Bøgh-Sørensen

(10) Patent No.: US 7,350,247 B2
(45) Date of Patent: Apr. 1, 2008

(54) HOISTING DEVICE

(75) Inventor: Ole Bøgh-Sørensen, Hornslet (DK)

(73) Assignee: V. Guldmann A/S, Aarhus N (DK)

( * ) Notice: Subject to any disclaimer, the term of this patent is extended or adjusted under 35 U.S.C. 154(b) by 0 days.

(21) Appl. No.: 10/577,544

(22) PCT Filed: Sep. 22, 2004

(86) PCT No.: PCT/DK2004/000641

§ 371 (c)(1),
(2), (4) Date: Sep. 11, 2006

(87) PCT Pub. No.: WO2005/041838

PCT Pub. Date: May 12, 2005

(65) Prior Publication Data

US 2007/0130690 A1 Jun. 14, 2007

(30) Foreign Application Priority Data

Oct. 31, 2003 (DK) ..... 2003 01616

(51) Int. Cl.
*A61G 7/14* (2006.01)

(52) U.S. Cl. ..... 5/83.1; 5/85.1; 5/89.1

(58) Field of Classification Search ..... 5/81.1 R, 5/83.1–87.1, 89.1; 254/329, 334, 342, 380; 294/82.11, 81.56, 81.61, 81.62, 81.51, 81.54, 294/82.1; 212/159, 327, 324; 104/89
See application file for complete search history.

(56) References Cited

U.S. PATENT DOCUMENTS

| | | | | |
|---|---|---|---|---|
| 3,452,964 A | | 7/1969 | Bibeault | |
| 4,202,064 A | * | 5/1980 | Joergensen | 5/83.1 |
| 4,243,147 A | * | 1/1981 | Twitchell et al. | 212/284 |
| 4,372,452 A | * | 2/1983 | McCord | 212/285 |
| 5,809,591 A | * | 9/1998 | Capaldi et al. | 5/83.1 |
| 6,174,010 B1 | | 1/2001 | Fänger et al. | |
| 6,478,171 B2 | | 11/2002 | Freeman | |
| 6,675,412 B2 | * | 1/2004 | Faucher et al. | 5/83.1 |
| 6,708,622 B2 | * | 3/2004 | Bergeron | 104/96 |
| 2006/0253977 A1 | * | 11/2006 | Hjort | 5/85.1 |

FOREIGN PATENT DOCUMENTS

| | | |
|---|---|---|
| CA | 2374118 | 1/2002 |
| DE | 19851708 | 5/2000 |
| JP | 53/008953 | 1/1978 |
| JP | 10/316375 | 12/1998 |

* cited by examiner

*Primary Examiner*—Michael Trettel
(74) *Attorney, Agent, or Firm*—James Creighton Wray; Clifford D. Hyra

(57) ABSTRACT

The present invention concerns a hoisting device including a hoisting module which is replaceably connected with a coupling arrangement for a trolley which is mounted in a ceiling-mounted rail arrangement, where the coupling arrangement is provided in two sections, where the first section is mounted on the hoisting module, and the second section is mounted in connection with the trolley, and where the hoisting module includes a lifting strap arranged for rolling up and unrolling and for fastening a lifting bracket and/or lifting canvas, where the first section of the coupling arrangement is mounted releasably on the hoisting module, that the first section and the second section of the coupling arrangement are mutually connected with a wire connection which is connected with a winding arrangement that includes means dimensioned for lifting the weight of hoisting module, lifting bracket and lifting canvas.

9 Claims, 11 Drawing Sheets

HOISTING DEVICE

This application claims the benefit of Danish Application No. PA 2003 01616 FILED Oct. 31, 2003 and PCT/DK2004/000641 filed Sep. 22, 2004, which are hereby incorporated by reference in their entirety.

SCOPE OF THE INVENTION

The present invention concerns a hoisting device including a hoisting module which is replaceably connected with a coupling arrangement for a trolley which is mounted in a ceiling-mounted rail arrangement, where the coupling arrangement is provided in two sections, where the first section is mounted on the hoisting module, and the second section is mounted in connection with the trolley, and where the hoisting module includes a lifting strap arranged for rolling up and unrolling and for fastening a lifting bracket and/or lifting canvas.

The invention furthermore concerns methods for using a hoisting device by suspending and taking down a hoisting module.

BACKGROUND OF THE INVENTION

In the health sector, e.g. in hospitals, old people's homes or in home care, mechanical aids are used for performing heavy lifting, e.g. lifting of a patient from bed to chair, or a person from a position in a house to another position in the house.

These mechanical hoisting devices have typically ceiling-mounted rails in which a hoisting module equipped with a height adjustable lifting strap is used, so that the lifting bracket fitted in the lifting strap may be elevated and lowered to the desired level. A lifting canvas is typically provided in the lifting bracket in which the user is placed when he is to be moved.

Typically, in a room with permanently installed hoisting device, there will be provided a number of ceiling-mounted rails and a lifting module so that the user, irrespectively of his position in the room, can be moved.

Since such a hoisting device with a hoisting module and a trolley mounted in the rails is expensive to purchase and install, it would be advantageous if the hoisting module could be carried from room to room in which a rail system is pre-mounted. This would reduce the costs of establishing hoisting devices on e.g. a hospital/nursing home as one hoisting module can be used for about every fifth room.

In order that this may be possible, the hoisting module is to be movable. This entails in turn that each time the assistant goes into a new room, the hoisting module is to be mounted before use and dismounted after use.

Today, different mobile hoisting modules exist which are either lifted up and put on the trolley manually, or the modules are placed in the trolley by means of e.g. auxiliary rods or hooks. The drawback of this is that each time the assistant is to suspend the hoisting module in the trolley, some physical work is required, and repeated mounting and dismounting will cause a considerable work load on the assistant.

Furthermore, there is another drawback of this system. The drawback is that the trolley is disposed in the ceiling-mounted rails which are typically at a level more than 2 m above the floor, meaning that the assistant is to lift hoisting module, typically weighing between 4 and 10 kgs, up from the floor and to an overhead position for mounting the hoisting module on the trolley at all. This movement is inexpedient for the assistant since it implies a heavy lift which according to the Labour Environment Act is to be reduced or entirely removed.

The trolleys may have hanging straps which is a disadvantage since the free height is reduced.

Another hoisting module is adapted so that the lifting strap is pulled from the hoisting module and up to the trolley and mounted in the trolley. This entails that one does not need to lift the hoisting module itself. The drawback of this is, however, that the lifting bracket, which is disposed directly under the hoisting module, causes that the person sitting in the lifting canvas will either get his view blocked by the hoisting module during the transport or hit his head against the hoisting module as it is situated at a level at which a person sitting in a lifting canvas will have his head. This is a great disadvantage for a person that cannot control his body movements by himself.

The existing mobile hoisting modules are also typically packed down into bags, where lifting bracket, lifting canvas, charger and batteries are packed down into the bag so that the assistant is to carry the bag from room to room or from a vehicle and into a flat. This is a drawback since the assistant is to perform a heavy lift again.

PURPOSE OF THE INVENTION

The purpose of the present invention is to indicate a mobile hoisting device that simultaneously reduces the physical load for the assistant.

This is achieved with a hoisting device including a hoisting module which is replaceably connected with a coupling arrangement for a trolley which is mounted in a ceiling-mounted rail arrangement, where the coupling arrangement is provided in two sections, where the first section is mounted on the hoisting module, and the second section is mounted in connection with the trolley, and where the hoisting module includes a lifting strap arranged for rolling up and unrolling and for fastening a lifting bracket and/or lifting canvas, and where the first section of the coupling arrangement is mounted releasably on the hoisting module, that the first section and the second section of the coupling arrangement are mutually connected with a wire connection which is connected with a winding arrangement that includes means dimensioned for lifting the weight of hoisting module, lifting bracket and lifting canvas.

DESCRIPTION OF THE INVENTION

The movable hoisting device specified by the present invention includes a hoisting module which in its basic form is the same hoisting module used in a stationary hoisting device.

This means that the hoisting module has the same functions as a common hoisting module, meaning that this hoisting module is provided so that it includes a lifting strap arranged for rolling up and unrolling and for attaching to a lifting bracket and/or lifting canvas.

In the hoisting module there will be a motor unit connected with a reel in which the lifting strap can be rolled in and unrolled from. This motor unit is an electric motor which is supplied with power from a battery integrated in the hoisting module.

In order that the hoisting module may be moved around in one or more rooms, the trolley of the hoisting device is mounted in a ceiling-mounted rail arrangement so that a fitted runner module via the trolley may be moved around in the rail arrangement in one or more rooms. The runner module is replaceably connected to a coupling arrangement for the trolley. This means that the hoisting module can be suspended when needed, and taken down when the need for a hoisting module arises in another room, or if there is no need for a hoisting module at all in the room.

This coupling arrangement is provided in two sections, where the first section is mounted on a top side of the hoisting module, and a second section is mounted in connection with the trolley. This entails that when the first and second sections are mutually engaged, the hoisting module will be fastened to the trolley.

The fastening is to be such character that the connection between the first and second section of the coupling arrangement may hold the weight of a hoisting module, a lifting bracket, a lifting canvas and a person. Together it will typically be about 150 to 300 kg.

In order to use a hoisting module which is a part of movable hoisting device, the first section of the coupling arrangement will be mounted releasably on the hoisting module. This entails that in each room there is to be a coupling arrangement in which a first section is mounted, so that this first section can be mounted on the hoisting module that is transported between the rooms.

Furthermore, the first section and second section of the coupling arrangement are to be mutually connected with a wire connection. This entails that the second section, which is mounted in connection with the trolley, is disposed at a position close to or up under the ceiling of the room, while the first section of the coupling arrangement mounted in the other end of the wire connection may be disposed at an arbitrary position between ceiling and floor.

In order to elevate and lower the hoisting module which has been connected with the first section of the coupling arrangement, the wire connection is connected with a winding arrangement that includes means dimensioned for lifting the weight of the hoisting module, the lifting bracket and the lifting canvas.

This entails that by activation of the winding arrangement, the wire connection may either be rolled out so that it is possible to move the first section of the coupling arrangement away from the second section of the coupling arrangement and up to the hoisting module where it may be fastened or rolled up, causing the first and second sections to approach each other.

In order to reduce the extent/size of the means that are to be provided in order that the winding may function, these means are dimensioned for lifting the weight only of the hoisting module, the lifting bracket and the lifting canvas. I.e. the winding arrangement and the wire connection cannot be used for height adjustment of the hoisting module when a person sits in the lifting canvas.

In an embodiment of the invention, the trolley is designed so that the trolley includes a winding reel for the wire connection. This means that the winding reel, which is disposed in the trolley, will be the place where the wire connection is rolled up when the hoisting device is not in use.

In the preferred embodiment of the invention, this winding reel is made so that it functions just as the rolling up and down arrangement on a roller blind whereby the wire connection can be disposed and maintained at different levels, enabling the wire connection to be reeled to the various positions where the hoisting module can be disposed.

In a first embodiment of the invention, the means of the winding arrangement are integrated in the hoisting module and includes a reel and a motor unit. These means are built into the hoisting module so that the hosting module does not appear from the outside as something more than a very usual hoisting module for permanent rail mounting. The only difference that may be is that a hoisting module for a movable hoisting device is made with an extra frame in which the first section of the coupling arrangement is coupled, meaning that the lifting height is slightly reduced.

In order to operate the winding arrangement separately from the hoisting module, the means of the winding arrangement are made with a reel on which the wire connection is to rolled up and a motor unit connected to the reel so that the wire connection can be rolled up until the first section of the coupling arrangement reaches and engages the second section of the coupling arrangement.

The first section of the coupling arrangement is mounted releasably on the hoisting module, e.g. by a bayonet socket, where the first section of the coupling arrangement is made with projecting parts that fit into a recess/opening on the locking bracket of the winding arrangement, so that the first section is pressed through the openings on the locking bracket and are turned so that the two projecting parts move in and lock about the locking bracket and thereby secure the first section of the coupling arrangement to the locking bracket. An alternative to a bayonet socket may be a screw thread, a magnetic coupling, a snap-action coupling or similar.

When the wire connection is stretched out between the winding reel that is connected to the trolley and down to the reel of the winding arrangement, the reel of the winding arrangement is designed so that it may get hold of the wire connection and thereby begin rolling up on the reel in the rolling arrangement.

An upwards movement of the hoisting module will, however, only occur when the wire connection is rolled off the winding reel at the trolley, after which the reel, on which the wire connection is rolled up into the hoisting module, by continued rolling up will provide for the hoisting module being elevated up against the trolley.

In a second embodiment of the invention, the means of the winding arrangement are integrated in the trolley and include a reel and a motor unit. By placing the means of the winding arrangement in the trolley instead of changing the hoisting module for the existing stationary hoisting devices, one may use a common hoisting module on which is provided a locking bracket which is made with the previously mentioned coupling possibilities for the first section of the coupling arrangement.

The reel on which the wire connection is provided, will again be of the type that functions according to the roller blind principle, so that one may dispose the end of the wire connection with the first section at an arbitrary level and hold it at an arbitrary level. This, however, requires a release option between reel and motor unit.

This entails that the wire connection by unrolling can be passed from ceiling and down towards the floor, where the hoisting module is located in a cart/support holder. After that, rolling up of the wire connection will entail that the hoisting module will be elevated from a cart/support holder and up towards the ceiling.

In order to control the hoisting and lowering of the hoisting module, the winding arrangement furthermore includes a control unit and a remote control unit. Besides, the control unit will also include the safety measures required to ensure that the hoisting module cannot be lifted any further or falls down for mechanical and technical reasons.

One of the safety measures is e.g. a friction coupling which is disposed either in the winding arrangement or in connection with a possible winding reel with the trolley.

Furthermore, this friction coupling with entail that the wire connection is not entirely rolled up if the motor unit in the hoisting module is overloaded, e.g. if the hoisting module is completely at the top, or if the hoisting module gets hold of something on the way up to the ceiling.

The remote control unit is either a wireless remote control or a remote control connected with a flexible wire to the runner module. This provides that it is possible to stand in a suitable position while hoisting and lowering the hoisting module. Furthermore, it will be possible to incorporate e.g. a wireless operating unit in the support holder on which the hoisting module is provided.

Alternatively, the remote control unit can be the same remote control used for manoeuvring the lifting strap of the hoisting module and for propelling the trolley.

In a third embodiment of the invention, the means of the rolling up arrangement is a manual winding reel provided with a control means and a trolley provided with a reversing reel.

In this embodiment, it is manual lifting which is performed. This means that the winding reel e.g. may be a handle in which a spring loaded winding reel provided with control means may automatically roll up the wire connection, and by action of weight on the wire connection may unroll the wire connection, whereby the control means are used for controlling the specific unrolling and rolling up of the wire connection.

This implies that an assistant is still to lift the full weight of the hoisting module, but the way in which the hoisting module is lifted is more proper ergonomically, so that it is not so hard a load for the assistant to lift the hoisting module in place up under the ceiling. Hereby it is possible to mount the hoisting module manually in the rail, irrespectively how high the rail is mounted.

The wire connection is typically a cord or a wire which is so flexible that it may be rolled up on a winding reel with very small diameter. However, the cord/wire is to be of such strength that it may at least lift the weight of the hoisting module, the lifting bracket and the lifting canvas.

In order to have an easy and durable solution concerning the coupling arrangement, the coupling arrangement is provided with a click-coupling where the first and second sections of the coupling arrangement are mutually corresponding.

This entails that the coupling arrangement is easy to use since a click-coupling provides that the first and second sections of the coupling arrangement are to engage each other whereby they are locked.

By deactivation of e.g. the second section, it will be possible that the first section is released and thereby may be lowered.

In an embodiment of the invention, the click-coupling is designed so that the first section of the coupling arrangement is a pin with an undercut groove around the outer side, corresponding to the closure of the second section of the coupling arrangement in which there is either balls or cylindrical rollers that engage the undercut groove of the pin of the first section.

In an embodiment of the invention, the click-coupling is used in the following way: when the first section with the pin is brought up into the second section in which there is either balls or cylindrical rollers that catch the pin, a first pressure will cause these balls/cylindrical rollers to get hold of/be pressed into the undercut groove of the pin of the first section and thereby secure the first section in the second section.

In order to release, an upwards force of the first section will press the pin a length up into the second section of the coupling arrangement, whereby the second section of the coupling arrangement deactivates the squeezing action of the balls/cylindric rollers, and thereby the grip around the pin on the first section of the coupling arrangement is released, and the first section of the coupling arrangement is released, and thereby the hoisting module can be lowered.

Other alternative solutions would be using hooks that easily may engage each other, and by corresponding easy deactivation of one of the hooks, it may be released so that the first section of the coupling arrangement can be released, and thereby the hoisting module is lowered.

By using e.g., as previously mentioned, a first coupling section that has the shape of a pin with undercut groove, it will be possible to suspend other things in the same suspension.

This means e.g. that if the trolley is not used for moving a hoisting module, it may instead be used for suspending interim lamps/hospital equipment and the like that has locking brackets mounted.

In order to lift the hoisting module in a uniform and steady movement, a wire connection runs in an internal channel in both first section and second section of the coupling arrangement. As the wire connection is a flexible wire, the force of gravity of the first section of the coupling arrangement plus a possible hoisting module will provide that the wire connection is hanging in a preferably vertical direction, so that the tension through the second and first section of the coupling arrangement is a straight pull up along the wire connection.

In order not to overload the assistant, the hoisting device is designed so that it includes a support bracket with wheels, arranged for disposition, storage and/or transport of the hoisting module, the lifting bracket and/or the lifting canvas.

The support holder with wheels is used when the hoisting module is to be transported from place to place or from room to room, and it is adapted so that besides the hoisting module there is space for a lifting bracket and/or lifting canvas so when the assistant comes with the support holder, he has all the items required for enabling, after suspending the hoisting module and mounting the lifting bracket and the lifting canvas, lifting of the user, and this provides walking several times after the items is avoided.

Alternatively, the support holder may also be designed so that it is connected to the electric network via wire, so that when the hoisting module is back in the holder, there is a connection so that the battery in the hoisting module and/or the remote control unit can be charged again.

Suspending a hoisting module occurs according to the following steps:

The support holder with the hoisting module, lifting bracket and/or lifting canvas are disposed approximately vertically under an ceiling-mounted trolley;

by activation of the wire connection, the first section of the coupling arrangement is moved down to the hoisting module and is fastened thereto; and by activating the winding arrangement, the wire connection and the first section of the coupling arrangement are rolled up, and the second section is brought into lockable connection.

Taking down a hoisting module occurs according to the following steps:

The support holder is disposed approximately vertically below a ceiling-mounted trolley;

by activation of the winding arrangement, the first section and the second section of the coupling arrangement are mutually disengaged;

by activation of the wire connection, the hoisting module is moved down to the support holder and the first section of the coupling arrangement is released from the hoisting module; and the wire connection with the first section of the coupling arrangement is disposed at a position close to the trolley.

A hoisting device as described in the present invention may find application in the health sector, but it may also be applied within other industries, where a unit is preferably to be mounted in a ceiling-mounted fitting, e.g. the industrial sector, where e.g. lifting equipment is to be provided in a crane, or items are to be suspended in a rail and transported from delivery to processing machines.

SHORT DESCRIPTION OF THE DRAWING

The invention will then be described in more detail with reference to the accompanying drawing, in which.

DETAILED DESCRIPTION OF THE INVENTION

Figure 1:
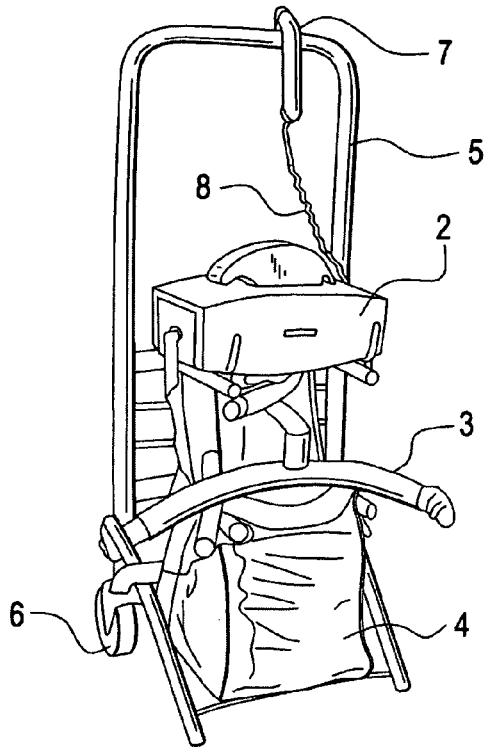
FIG. 1 shows a support holder with lifting module, lifting bracket and lifting canvas according to the invention.

On FIG. 1 is seen the mobile part of the hoisting device 1, where the hoisting module 2, lifting bracket 3 and a bag 4 containing lifting canvas (not shown) are mounted on a support holder 5 which is provided with wheels 6 that enable transporting hoisting module 2, lifting bracket 3 and lifting canvas (not shown) from room to room without great inconvenience.

In connection with support holder 5 and hoisting module 2 there is provided a remote control 7 which is shown here connected with a flexible wire 8 to hoisting module 2.

Figure 2:
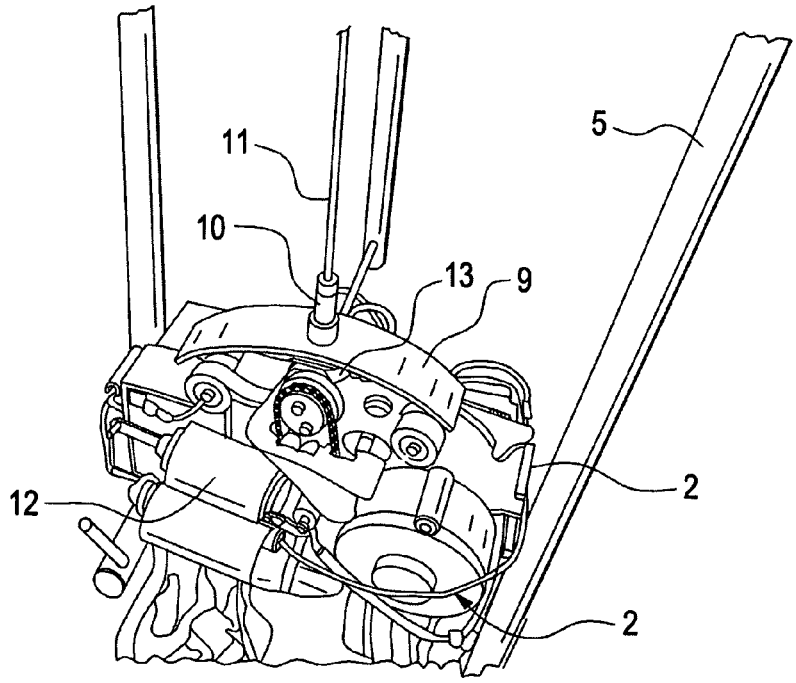
FIG. 2 shows a view of a lifting module without covering.

On FIG. 2 the hoisting module 2 appears without covering so that it is possible to see that this hoisting module 2 is designed with an integrated unrolling arrangement that includes a motor 12, a reel 13 and a locking bracket 9.

The motor unit 12 is coupled to the reel 13 via a chain so that by activation of the motor 12, rotation of the reel 13 will occur.

In order to lift the hoisting module 2 there is provided a locking bracket 9 in which the first section 10 of the coupling arrangement is secured. Through this first section 10, the wire connection 11 is disposed so that the wire connection 11 may be rolled up on the reel 13.

Figure 3:
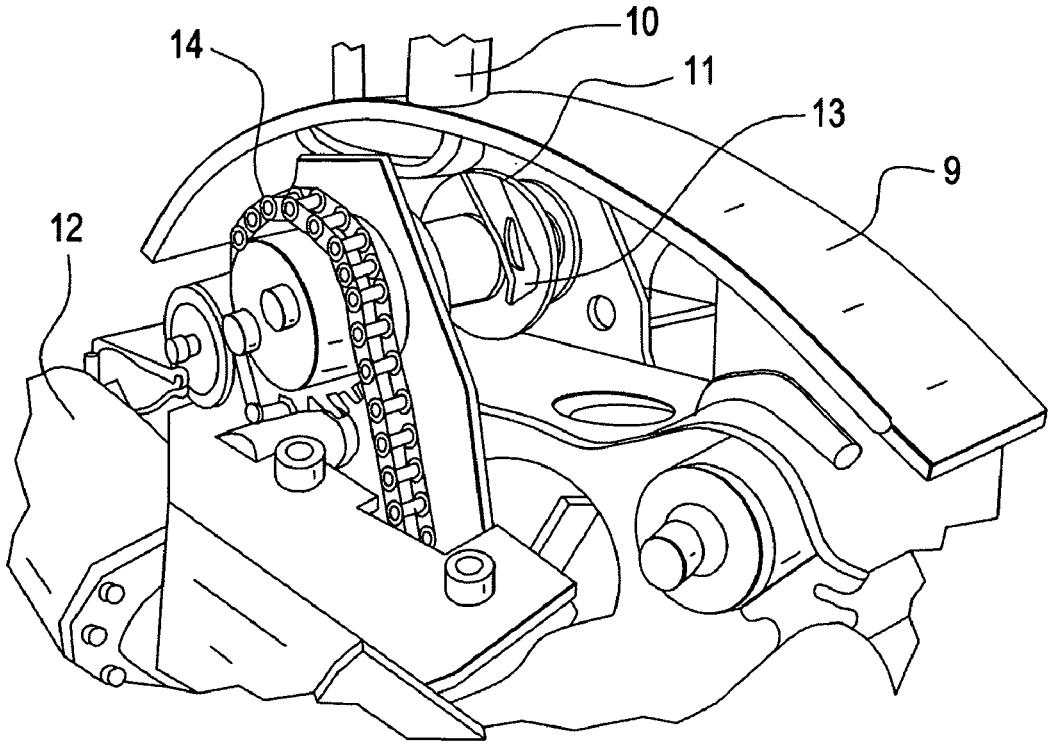
FIG. 3 shows a close-up view of the winding arrangement according to the invention.

On FIG. 3 is shown a close-up of the winding arrangement where it is clear that the wire connection 11 goes through the first section 10 of the coupling arrangement and has become rolled up on the reel 13, which occurs when the motor unit 12 is activated so that the chain 14 turns the reel in the desired direction.

Figure 4:
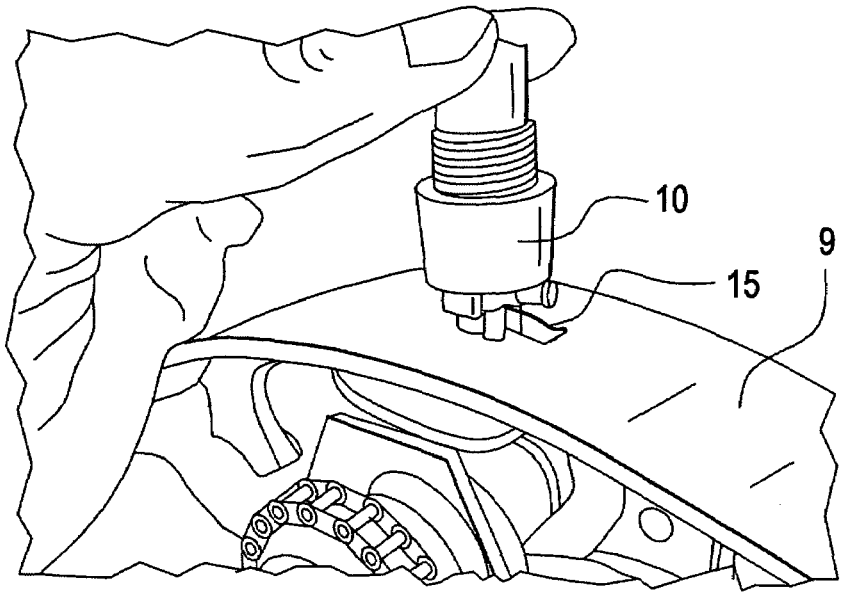
FIG. 4 shows a close-up view of the coupling of the first section to the hoisting module.

On FIG. 4 is shown how the first section 10 of the coupling arrangement and locking bracket 9 are couplet together by means of a bayonet socket 15.

Figure 5:
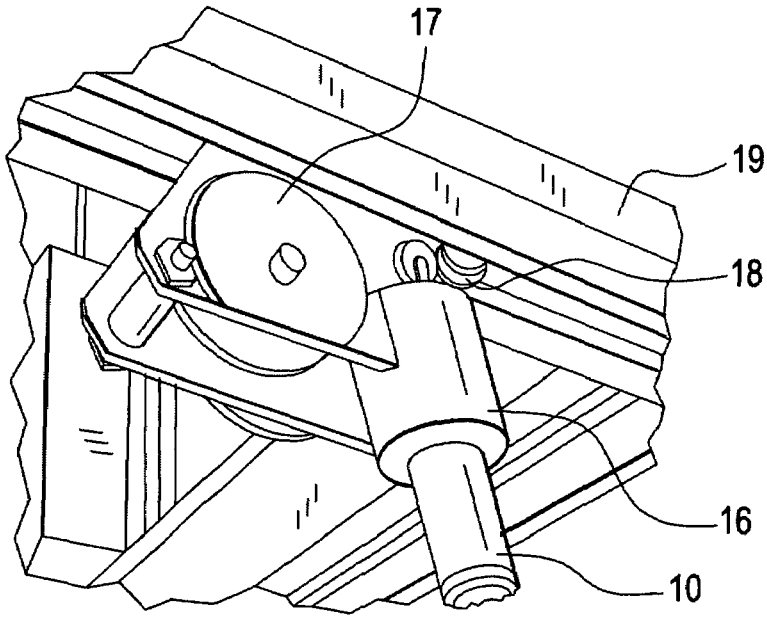
FIG. 5 shows a close-up view of the trolley according to the invention.
Figure 6:
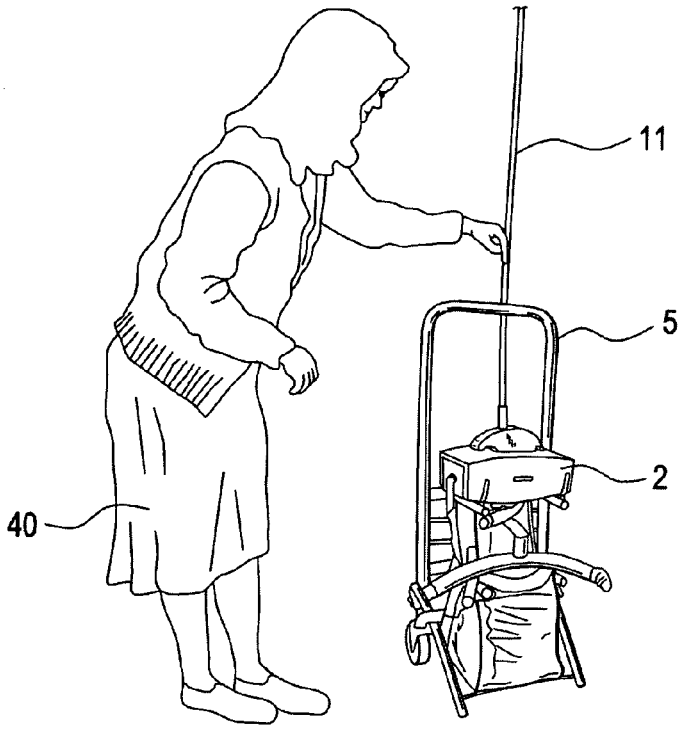
FIGS. 6-11 show how a hoisting module is suspended.
Figure 7:
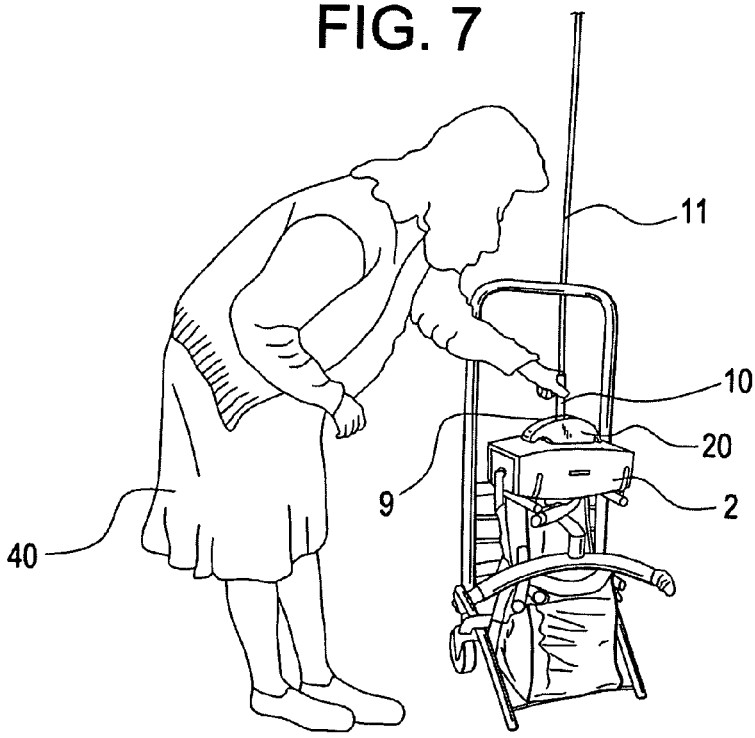

On FIG. 5 is shown how a trolley 18 is mounted in a ceiling-mounted rail 19, and that the trolley 18 includes a winding reel 17 and the second section 16 of the coupling arrangement. It is shown here how the first section 10 of the coupling arrangement is about to engage the second section 16 of the coupling arrangement. The winding reel 17 is used for rolling up the wire connection (not shown).

On FIGS. 6-11 is shown how a hoisting module 2 is suspended in connection with the trolley 11 which is mounted in a ceiling-mounted rail 19.

The person 40 drives the support holder 5 into a room in which there is a ceiling-mounted rail 19 and a trolley 18; then the person 40 takes a wire 11 and brings the first section 10 of the coupling arrangement in contact with the locking bracket 9 of the winding arrangement 20, whereby the first section 10 of the coupling arrangement is fastened.

Subsequently, the person 40 takes the remote control 7 and activated the winding arrangement 20, whereby the hoisting module 2 and lifting bracket 3 are lifted high from support holder 5.

Lifting bracket 3 is connected to hoisting module 2 via lifting strap 21.

Figure 8:
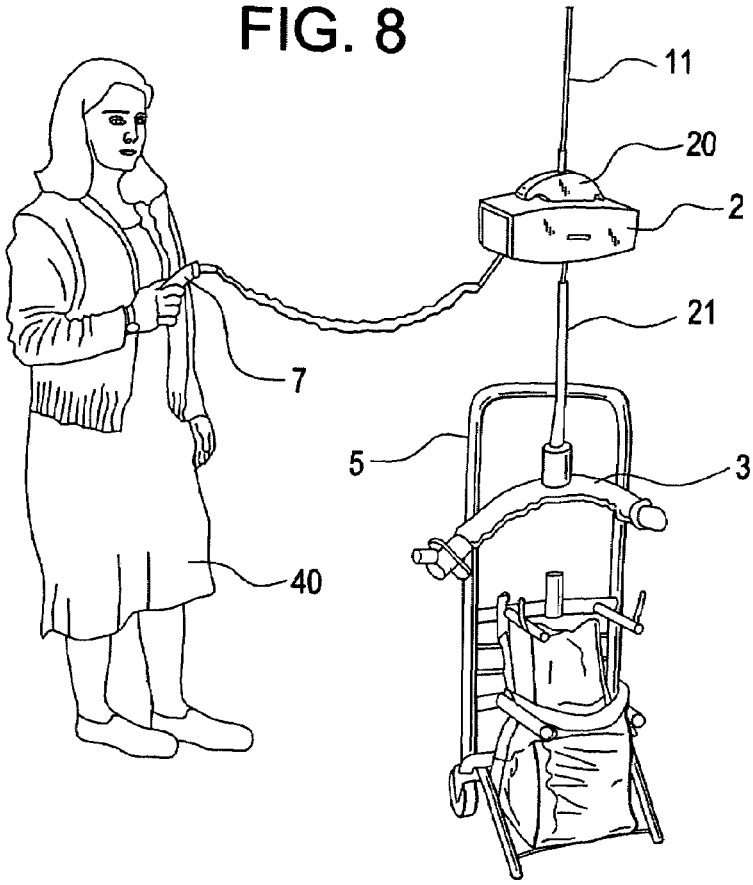
Figure 9:
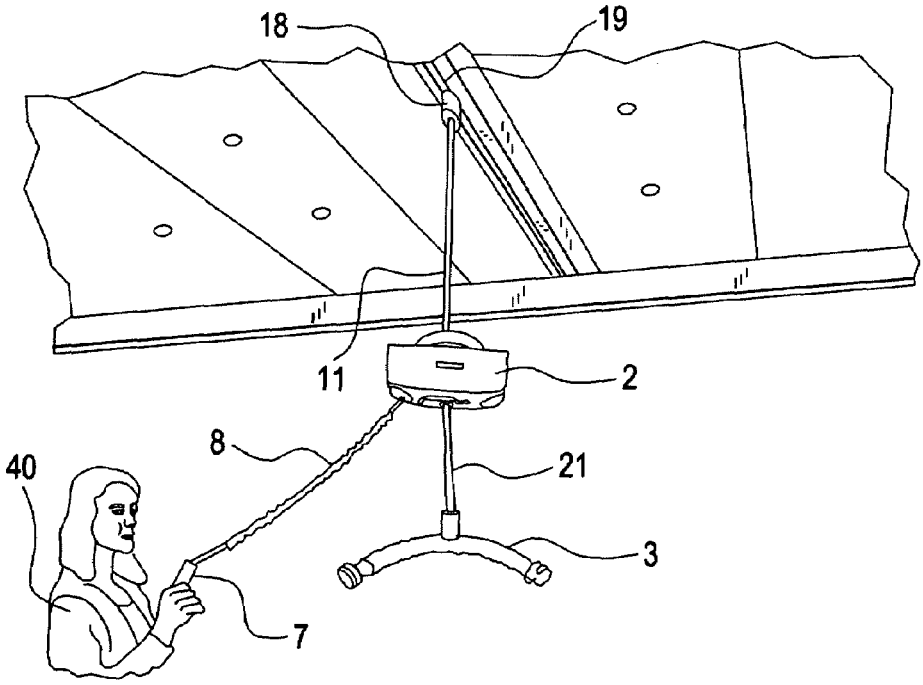
Figure 10:
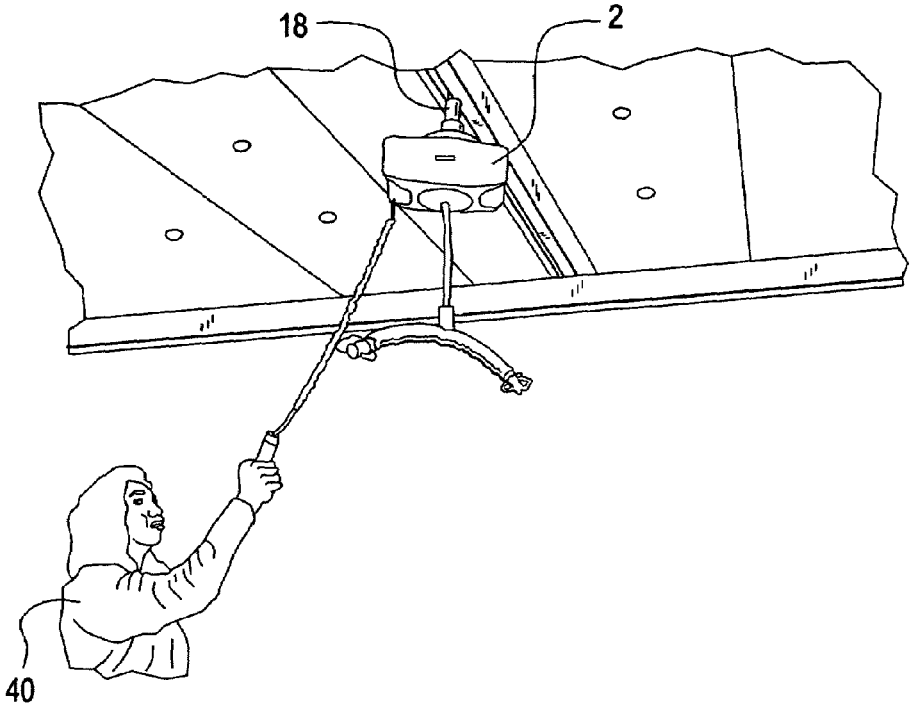

On FIGS. 8 and 9 may be seen how hoisting module 2 including lifting strap 21 and lifting bracket 3 are on their way up towards trolley 18 which is mounted in a ceiling-mounted rail 19.

The person 40 is still standing with remote control 7 which is connected with a flexible wire 8 to the hoisting module 2.

When the hoisting module 2 has reached the trolley 18, the two sections 10, 16 of the coupling arrangement engage, and hoisting module 2 will be secured in the trolley 18.

Figure 11:
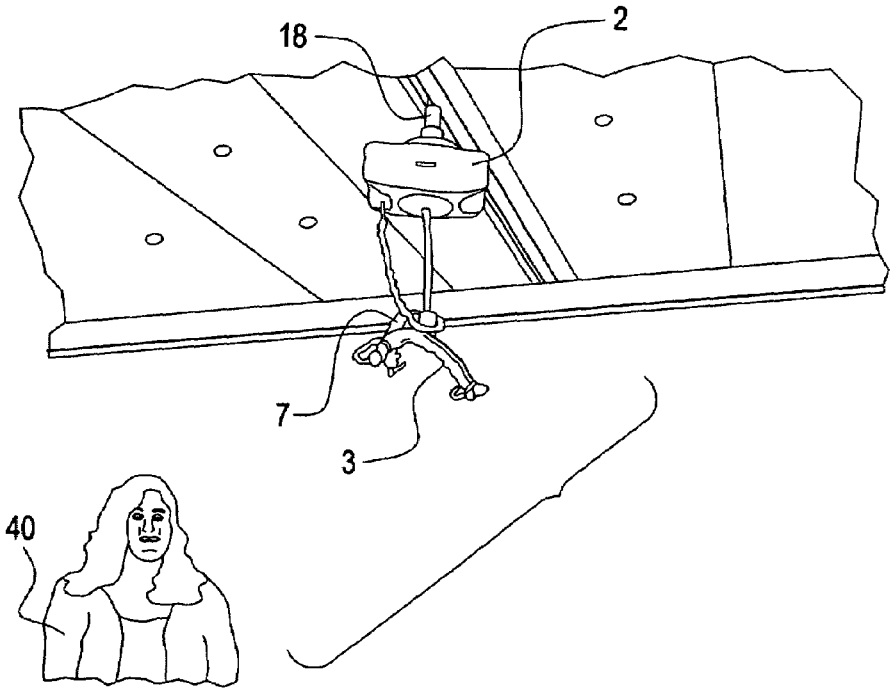
Figure 12:
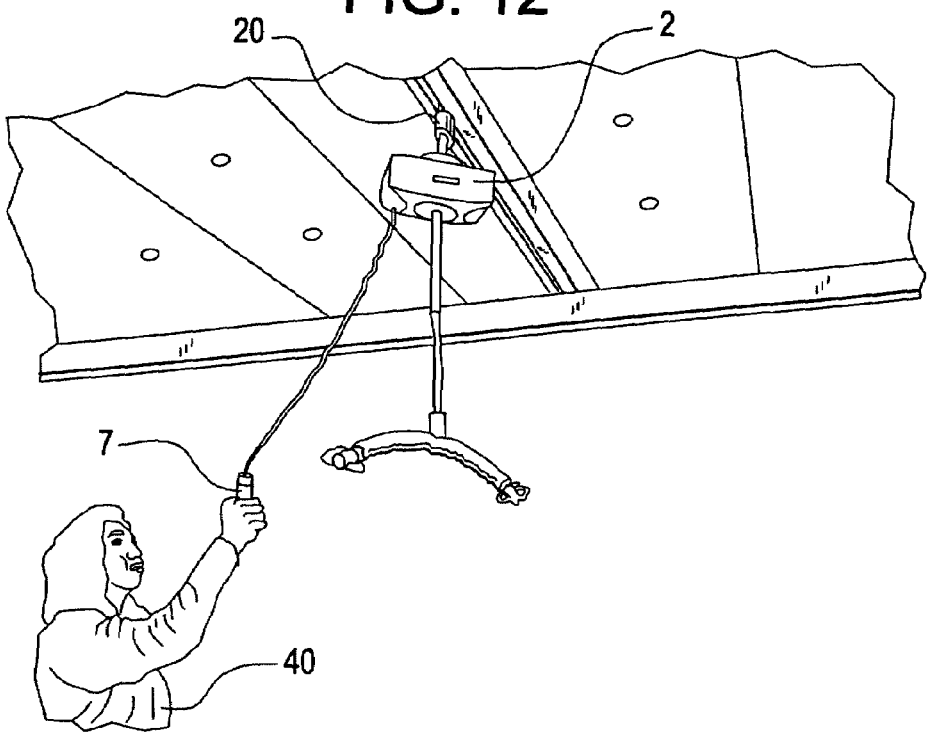
Figure 13:
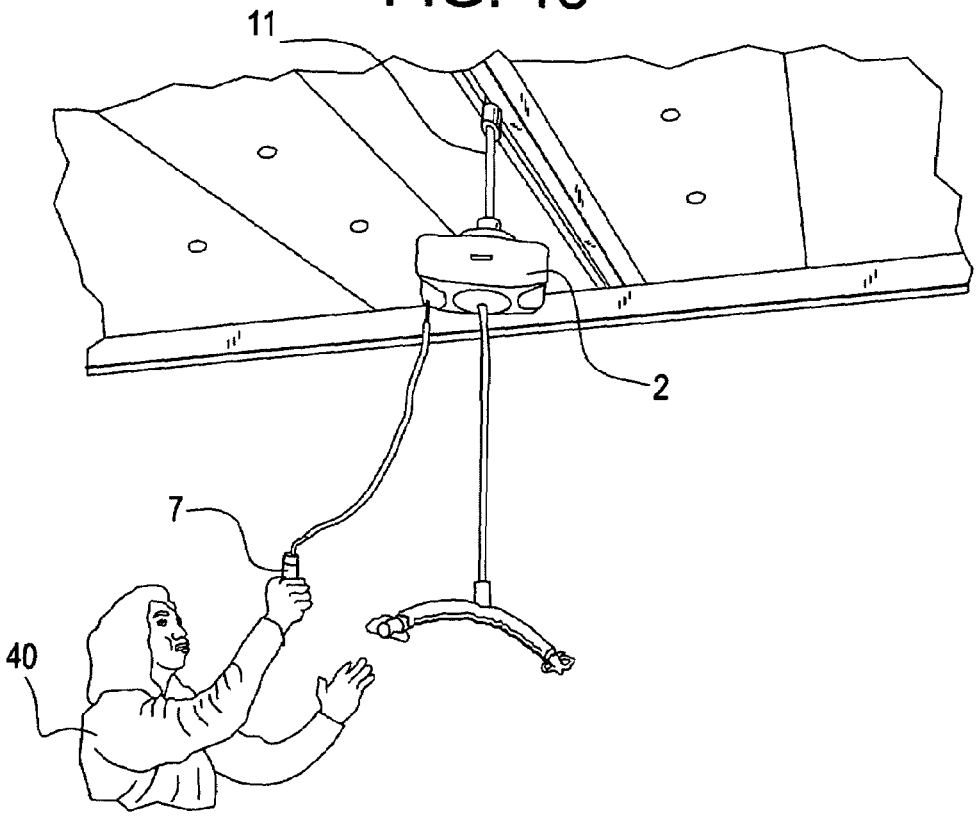
Figure 14:
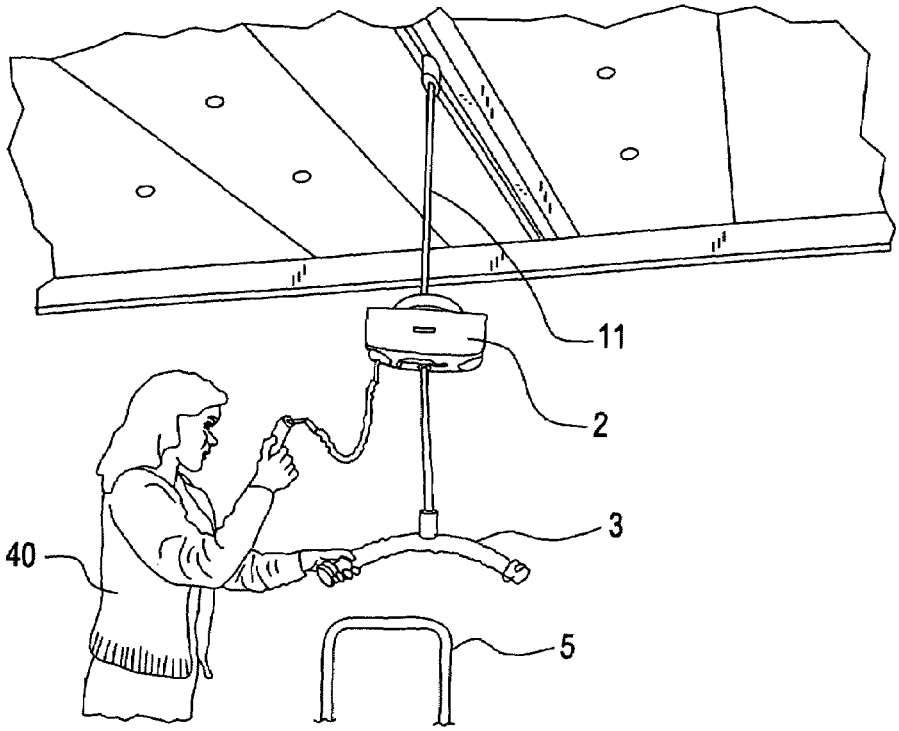
FIGS. 14-19 show how a hoisting module is taken down.
Figure 15:
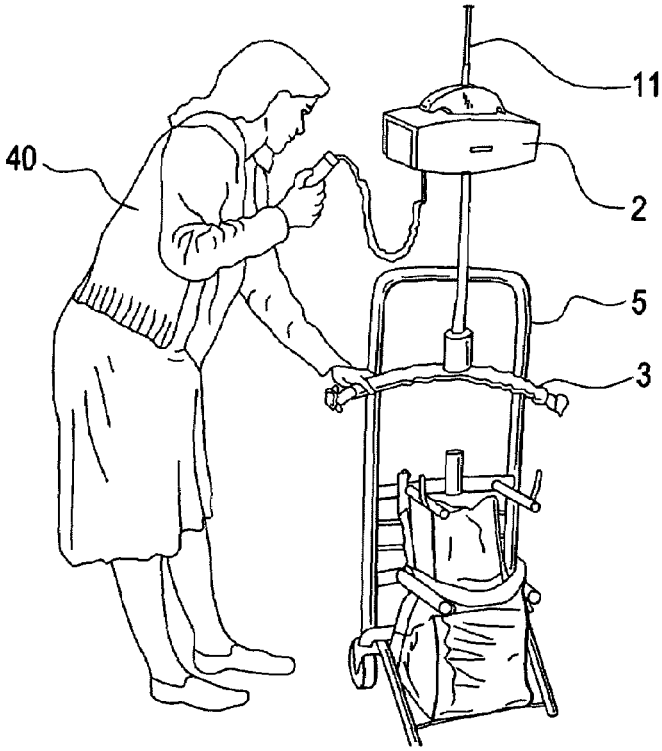
Figure 16:
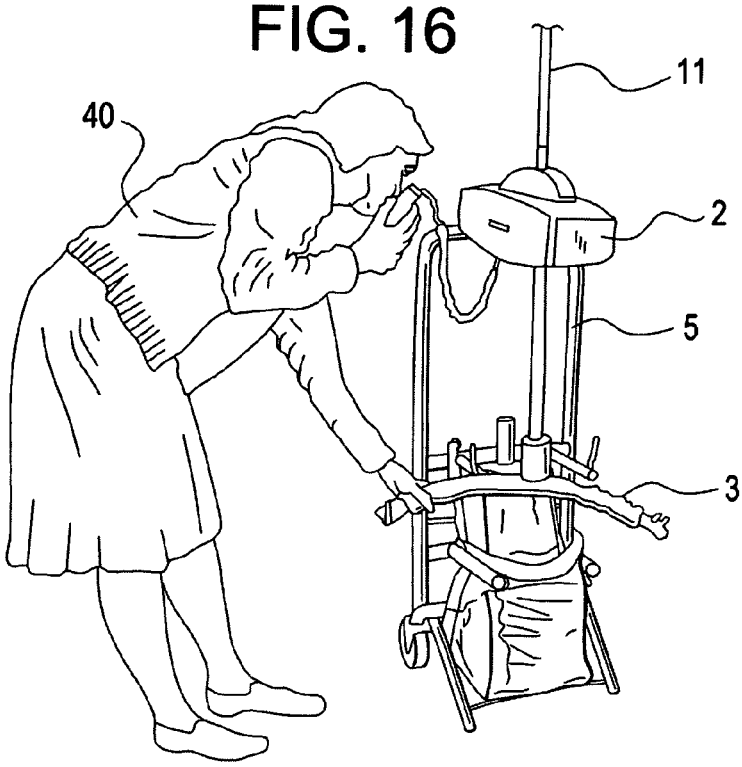
Figure 17:
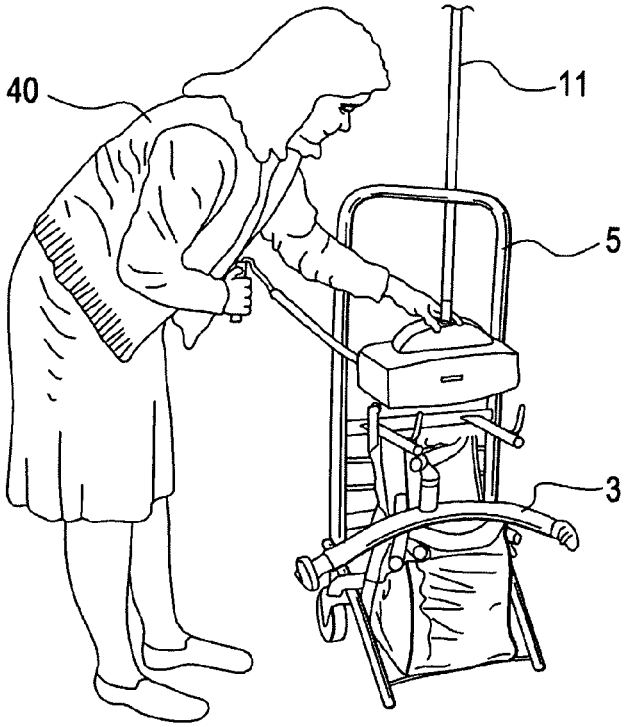

On FIG. 11 is seen how lifting module 2 is secured in trolley 18, and that the person 40 has suspended remote control 7 up on lifting bracket 3 so that now there is space for hanging the lifting canvas (not shown) in the lifting bracket 3, after which the person 40 possibly can use the remote control 7 to operate the hoist in the hoisting module 2.

On FIGS. 12-19 is shown how taking down of a lifting module 2 is effected. The person 40 takes the remote control 7 and activates the winding arrangement 20 so that the hoisting module 2 is hoisted up into the trolley 18 whereby the engagement of the coupling arrangement between first 10 and second 16 section is released, whereby the person 40 activates the remote control 7 so that hoisting module 2 can be lowered.

On FIGS. 13-17 is shown how the hoisting module 2 is gradually lowered while the person 40 gets hold of the lifting bracket 3 for guiding it in place in the support holder 5, after which the person 40 takes the hoisting module 2 for guiding it in place in the support holder 5. During the entire lowering, the person 40 holds fast in the remote control 7 in order to activate the unrolling of the wire connection 11.

Figure 18:
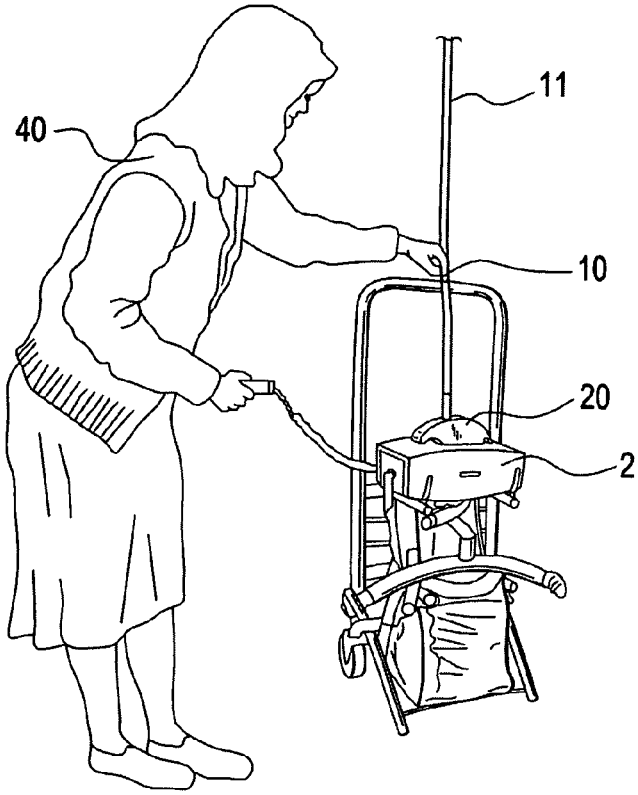
Figure 19:
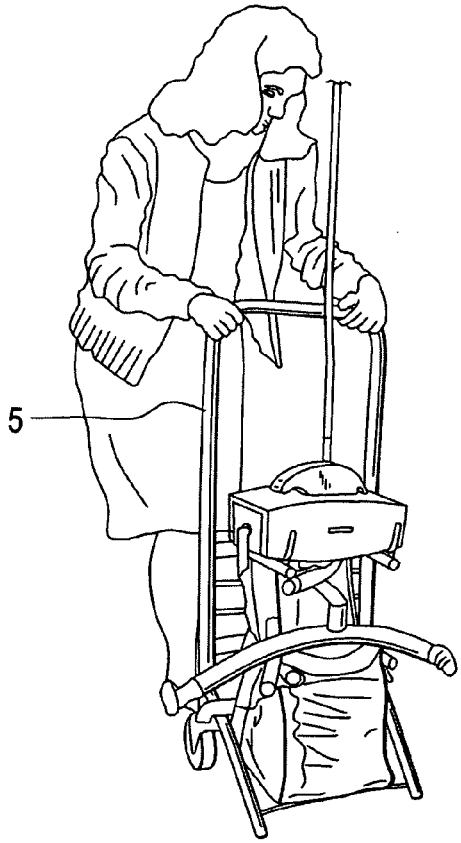

On FIGS. 18-19, the person 40 has released the first section 10 of the coupling arrangement from the winding arrangement 20 which is mounted on the hoisting module 2. The first section 10 of the coupling arrangement is now released so that it is hanging loosely in the wire connection 11. The person 40 can now get hold of the support holder 5 and moves the mobile part of the hoisting device 1 away or further on to another position.

Figure 20:
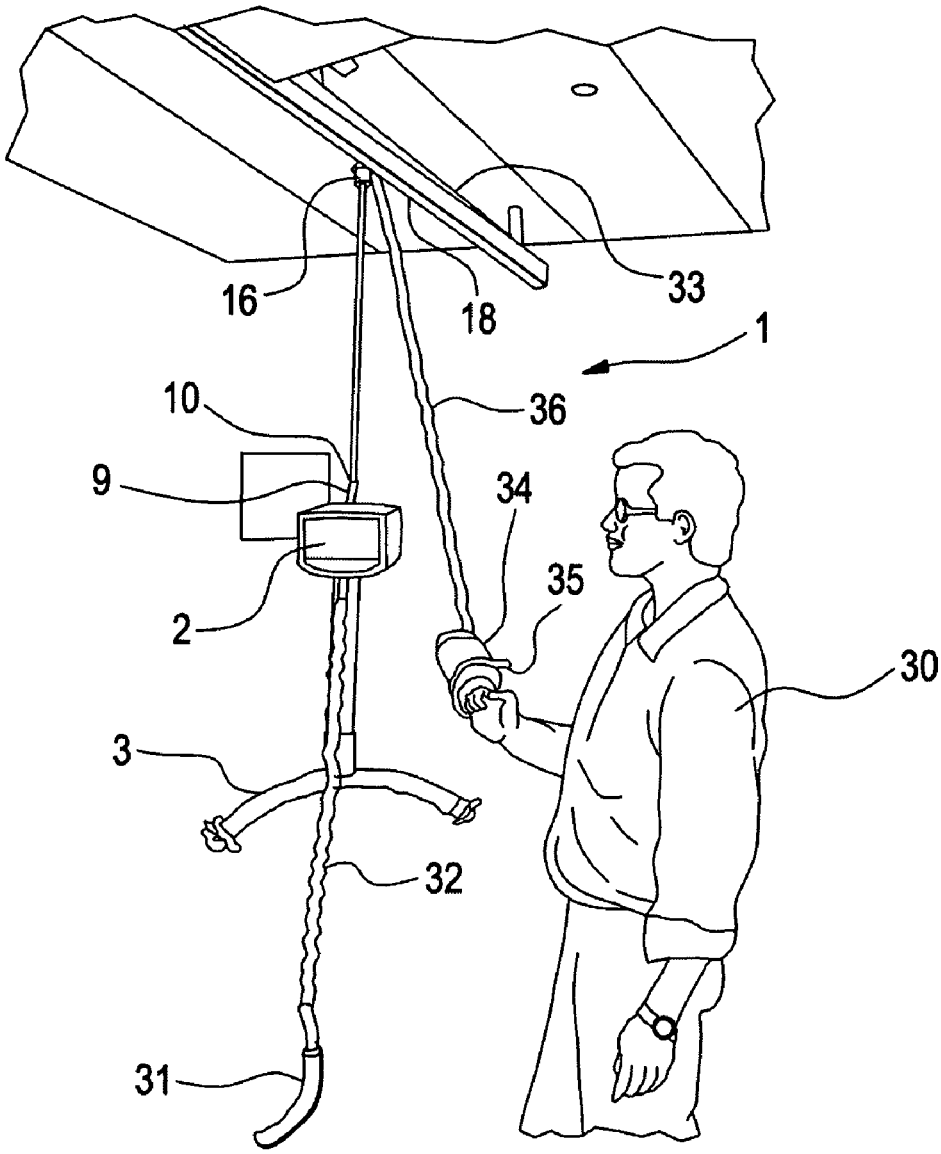
FIG. 20 shows an alternative embodiment of the hoisting device according to the invention.

On FIG. 20 is seen how a person 30 uses an alternative embodiment of the lifting arrangement 1 which includes a hoisting module 2 and a lifting bracket 3. The hoisting module 2 has its own remote control 31 hanging in a flexible wire 32 which is connected to the hoisting module 2.

Again, the coupling arrangement consists of a first section 10 which is coupled to a locking bracket 9 connected to the hoisting module 2. The trolley 18 is mounted in a ceiling-mounted rail 33 and now only includes the second section 16 of the coupling arrangement.

In order to elevate and lower the hoisting module 2, the person 30 has a manual winding reel 34 which is provided with control means 35 that enables locking the wire connection 36 at a certain position, whereby it becomes possible to pull in the winding reel 34 and thereby possible to lift the hoisting module 2, or by deactivating the control means 35 so that the wire connection 36 is loosened, it will be possible to lower the hoisting module 2.

The invention claimed is:

1. Hoisting device including a hoisting module which is replaceably connected with a coupling arrangement for a trolley which is mounted in a ceiling-mounted rail arrangement, where the coupling arrangement is provided in two sections, where the first section is mounted on the hoisting module, and the second section is mounted in connection with the trolley, and where the hoisting module includes a lifting strap arranged for rolling up and unrolling and for fastening a lifting bracket and/or lifting canvas, wherein the first section of the coupling arrangement is mounted releasably on the hoisting module, that the first section and the second section of the coupling arrangement are mutually connected with a wire connection which is connected with a winding arrangement that includes means dimensioned for lifting the weight of hoisting module, lifting bracket and lifting canvas.

2. Hoisting device according to claim 1, wherein the trolley includes a winding reel for the wire connection.

3. Hoisting device according to claim 1, characterised in that wherein the means of the winding arrangement are integrated in the hoisting module and includes a reel and a motor unit.

4. Hoisting device according to claim 1, wherein the means of the winding arrangement are integrated in the trolley and includes a reel and a motor unit.

5. Hoisting device according to claim 1, wherein the winding arrangement furthermore includes a control unit and a remote control unit.

6. Hoisting device according to claim 1, wherein the means of the winding arrangement is a manual winding reel which is provided with a control means, and wherein the trolley is provided with a reversing reel.

7. Hoisting device according to claim 1, wherein the coupling arrangement is provided with a click-coupling, where the first section and the second section of the coupling arrangement are mutually corresponding.

8. Hoisting device according to claim 1, wherein a wire connection is running in an internal channel in both first section and second section of the coupling arrangement.

9. Hoisting device according to claim 1, wherein it includes a support holder with wheels adapted for positioning, storing and/or transporting the hoisting module, the lifting bracket and/or the lifting canvas.

* * * * *